US005575027A

United States Patent [19]

Mueller

[11] Patent Number: 5,575,027

[45] Date of Patent: Nov. 19, 1996

[54] METHOD OF SUPPORTING A CHEST AND ABDOMEN AND APPARATUS THEREFOR

[76] Inventor: George B. Mueller, 3540 Chalet La., Crete, Ill. 60417

[21] Appl. No.: 423,877

[22] Filed: Apr. 18, 1995

[51] Int. Cl.[6] ..... A61G 7/06

[52] U.S. Cl. ..... 5/621; 5/630; 5/632; 5/424; 128/876; 128/869; 128/845

[58] Field of Search ..... 5/607, 621, 624, 5/630, 631, 632, 424, 425, 427; 128/845, 846, 847, 869, 870, 876; 602/33, 35

[56] References Cited

U.S. PATENT DOCUMENTS

| | | | |
|---|---|---|---|
| 2,724,133 | 11/1955 | Sorrell | 5/630 X |
| 3,389,702 | 6/1968 | Kennedy | 5/631 X |
| 3,474,281 | 10/1969 | Gaylord, Jr. | 128/876 |
| 3,823,081 | 3/1975 | Smith | 5/621 |
| 4,397,052 | 8/1983 | Lund, III | 5/632 X |
| 4,536,903 | 8/1985 | Parker | 5/632 X |
| 4,655,207 | 4/1987 | Ellis | 128/876 X |
| 4,944,054 | 7/1990 | Bossert | 602/33 X |
| 5,357,641 | 10/1994 | Schubert | 5/632 X |

FOREIGN PATENT DOCUMENTS

| | | | |
|---|---|---|---|
| 1088189 | 9/1960 | Germany | 5/630 |

*Primary Examiner*—Michael F. Trettel
*Attorney, Agent, or Firm*—Bernard L. Kleinke; Peter P. Scott

[57] ABSTRACT

The method of supporting the chest and abdomen areas of a person laying in a supine position includes applying pressure to one side of the chest or abdomen with a body engaging member. Similarly, pressure is applied to the other side of the chest or abdomen with another body engaging member to provide sufficient oppositely directed force to the chest or abdomen areas for providing lateral support thereto. The application of the pressure to both sides of the chest or abdomen is maintained, thereby restraining the chest or abdomen between the opposing body engaging members. A further embodiment includes applying pressure to the lower abdomen with a strap member coupled between a pair of upright members, and maintaining the application of the pressure thereon with a buckle.

15 Claims, 2 Drawing Sheets

METHOD OF SUPPORTING A CHEST AND ABDOMEN AND APPARATUS THEREFOR

TECHNICAL FIELD

The present invention relates in general to an improved method of supporting a torso, and an apparatus therefor. The invention more particularly relates to a method of supporting a chest and abdomen area of a person laying in a supine position for increasing the comfort of the person, which can be accomplished with a novel apparatus.

BACKGROUND ART

The use of rigid side guards with hospital beds is well known for preventing injuries to persons confined to the beds. For example, reference may be made to U.S. Pat. Nos. 5,083,334 and 5,179,744.

As disclosed in the aforementioned patents, various configurations of side guards are secured to opposite sides of a hospital bed. U.S. Pat. No. 5,083,334 describes side guards that are pivotally connected to a hospital bed base. The side guards can be raised above the bed to provide a vertical barrier for preventing a bedridden person from accidentally falling over the sides of the bed, thereby incurring injuries. Alternatively, the side guards can be lowered below the bed to enable the person to be placed on, or removed from, the bed without being hindered by the side guards.

Similarly, U.S. Pat. No. 5,179,744 describes side guards mounted to opposite sides of a hospital bed to prevent the patient from falling over the side of the bed. The side guards are movable inwardly to enable the width of the bed to be adjusted from a full size bed width of about 42 inches to a narrow stretcher size bed having a width of about 34 inches. Reducing the width of the bed facilitates transporting the patient from place to place. In this regard, reducing the width of the bed enables it to pass through corridors and doorways, and to negotiate corners with ease.

Although such side guards have been satisfactory for preventing injuries, they do not afford any relief to discomfort suffered by a person due to their confinement to the bed. U.S. Pat. Nos. 3,800,342 and 4,287,620 are representative of previous methods and apparatus for alleviating the discomfort of a person resting on a hospital bed.

U.S. Pat. No. 3,800,342 describes a body support assembly for supporting the body from below the bed by means of an envelope containing a fluid. The assembly includes sideboard members pivotally connected to the base of the bed, wherein the envelope extends over the sideboards as well as the base. In order to adjust the depth of the envelope over the base to accommodate persons of varying weight thereon, the sideboards can be raised or lowered accordingly.

For example, a heavy person requires the sideboards to be raised, thereby concentrating the fluid in the envelope above the base and preventing the fluid from entering the envelope adjacent to the sideboards due to the force of gravity. This ensures that the depth of the envelope under the patient is sufficiently deep to support the body weight above the base. In this way, the person floats on a cushion of fluid above the base to prevent high pressure points where the body weight would normally be concentrated at the base, thereby avoiding the occurrence of bedsores.

The support of a patient is accomplished in U.S. Pat. No. 4,287,620 by using pillow like side guards on the hospital bed in the vicinity of the head to prevent it from rolling to its side. In addition, there is described therein left and right side longitudinal supports connected rotatably to the bed which can be raised to facilitate turning the patient over.

In this regard, one of the side longitudinal supports is raised, depending upon whether it is desired to place the patient on their right or left side. By raising one of the side longitudinal supports, a force is applied to one side only of the patient, thereby raising the associated side of the patient and reducing the work required to turn the patient partially over. Once the patient has been repositioned on their side, the side longitudinal support is lowered and disengaged from the patient.

While such body support apparatus may have been adequate to prevent bedsores, to prevent the head from rolling sideways, or to facilitate turning a patient partially over, it would be highly desirable to have a new and improved method of supporting the chest and abdomen of a person laying in a supine position, and the apparatus for doing so. In particular, obese persons suffer from discomfort due to laying in a supine position on a bed or other similar horizontal surface for extended periods of time. In this regard, the body weight itself presses down on internal cavities and organs of the body under the force of gravity. The resulting compression of the chest and abdomen can make the person feel as though they are being crushed under their own body weight, and can cause chest pains, among other things.

Similarly, pregnant women suffer from the compression of the abdomen due to gravitational forces. The additional body weight due to the presence of the growing fetus tends to press down on internal organs and cavities, thereby increasing the discomfort of the person.

The discomfort associated with gravitational forces compressing the chest and abdomen areas of obese or pregnant persons is compounded during surgical procedures. In this regard, the weight of the body mass pressing down on the unsupported chest and abdomen can cause the person to experience breathing difficulties. To ensure that breathing during the surgical procedure is not reduced to a dangerous level, the insertion of a breathing tube for facilitating fluid communication between the lungs and a source of oxygen may be required. Thus, the obese or pregnant person might have to endure the crush of their own weight, as well as the insertion of a breathing tube into a body cavity, such as the nasal or oral cavity, during the surgical procedure.

Therefore, it would be highly desirable to have a new and improved method of supporting a chest and abdomen, and an apparatus for accomplishing the same. Such a method should reduce the discomfort felt by obese or pregnant persons laying in a supine position, and should be accomplished with an apparatus that can be easily adjusted for persons of varying sizes and weights.

DISCLOSURE OF INVENTION

Therefore, the principal object of the present invention is to provide a new and improved method of supporting a chest and abdomen, and an apparatus therefor, wherein the method relieves the discomfort felt by obese or pregnant persons laying in as supine position, and which method is accomplished with an apparatus that can be easily adjusted for persons of varying sizes and weights.

Briefly, the above and further objects of the present invention are realized by providing a new and improved method of supporting a chest and abdomen, and an apparatus therefor, which relieves the discomfort felt by obese or pregnant persons laying in a supine position, and which method is accomplished with a novel apparatus of the present invention that can be easily adjusted for persons of varying sizes and weights.

The method of supporting the chest and abdomen areas of a person laying in a supine position includes applying pressure to one side of the chest or abdomen with a body engaging member. Similarly, pressure is applied to the other side of the chest or abdomen with another body engaging member to provide sufficient oppositely directed force to the chest or abdomen areas for providing lateral support thereto. The application of the pressure to both sides of the chest or abdomen is maintained, thereby restraining the chest or abdomen between the opposing body engaging members. A further embodiment includes applying pressure to the lower abdomen with a strap member coupled between a pair of upright members, and maintaining the application of the pressure thereon with a buckle.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 2:
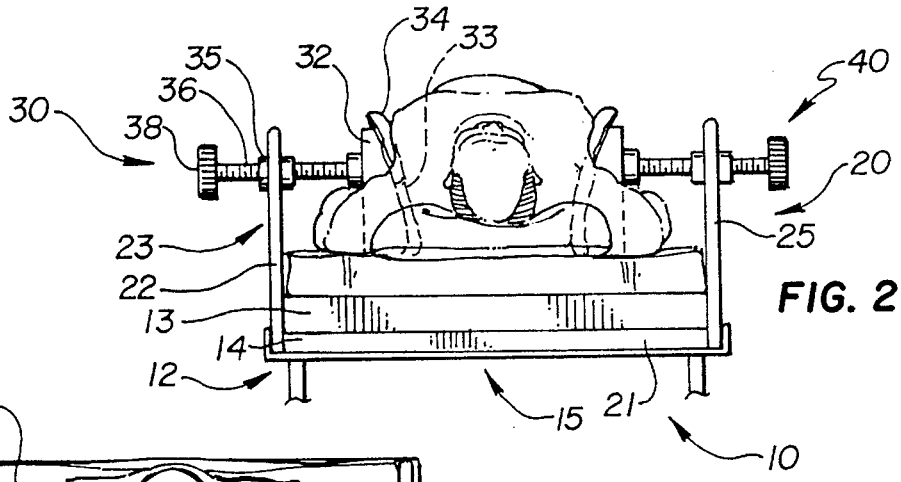
FIG. 2 is an elevational view the chest and abdomen supporting apparatus of FIG. 1.
Figure 1:
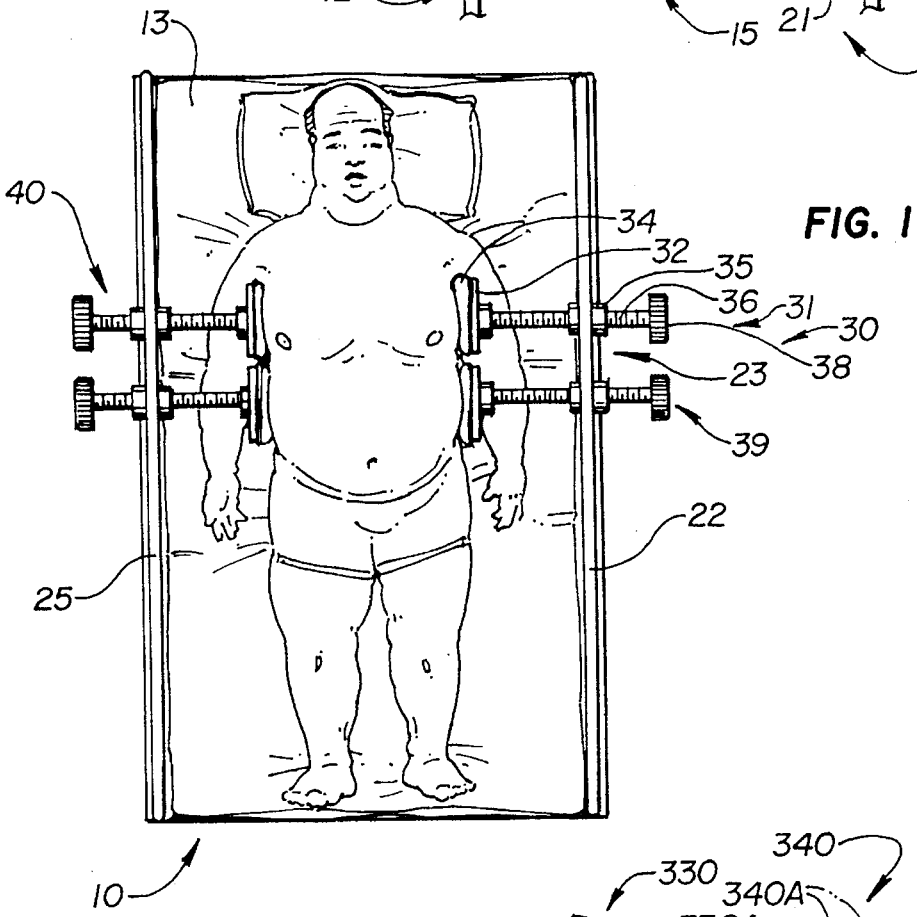
FIG. 1 is a plan view of a chest and abdomen supporting apparatus, which is used and constructed in accordance with the present invention.

Referring now to the drawings, and more particularly to FIGS. 1 and 2 thereof, there is shown a chest and abdomen supporting apparatus 10, which is constructed in accordance with the present invention. The apparatus 10 is adapted for use with a bed 12 having a mattress 13 and a box spring 14 thereon, wherein the bed 12 is supported above the ground by a frame 15. It will be understood by one skilled in the art that the bed 12 could comprise any type of horizontal surface for enabling a person to lay in a supine position, including hospital beds and residential beds.

The apparatus 10 generally comprises a support frame assembly 20 having a left vertical wall 22 and a right vertical wall 25 connected orthogonally to opposite sides of a lower member 21. A left side support assembly 30 cooperates with the left vertical wall 22 to apply pressure to the left side of the chest or abdomen areas, and to maintain the application of pressure thereto. A right side support assembly 40 cooperates with the right vertical wall 25 to apply pressure to the right side of the chest or abdomen, and to maintain the application of pressure thereto, wherein the pressure applied by the right side support assembly 40 is in opposition to the pressure applied by the left side support assembly 30 to provide sufficient lateral support to chest or abdomen. In this way, the chest or abdomen is prevented from collapsing down on the internal cavities or organs of the body, thereby causing discomfort to the person.

In operation, the person is positioned on the bed 12 in between the left side support assembly 30 and the right side support assembly 40. The left side support assembly 30 is moved into engagement with the left side of the chest or abdomen areas to facilitate the application of pressure thereto. Similarly, the right side support assembly 40 engages the right side of the chest or abdomen areas to facilitate the application of pressure to the right side of the torso. The left side support assembly 30 is adjusted to apply sufficient pressure to the left side of the torso to help facilitate the lateral support or the chest or abdomen. Once adjusted, the application of the sufficient pressure to the left side is maintained.

The right side support assembly 40 is adjusted to apply sufficient pressure to the right side of the torso, wherein the application of pressure by the right side support assembly 40 is in opposition to the pressure applied by the left side support assembly 30 to compress sufficiently and laterally the chest or abdomen for enabling the lateral support thereof. As a result of engaging both sides of the chest or abdomen, the person is secured forcibly between the left side support assembly 30 and the right side support assembly 40, thereby causing pressure to be applied to both sides of the chest or abdomen. The application of pressure to the right side is then maintained to restrain laterally the chest or abdomen between the left side support assembly 30 and the right side support assembly 40. In this regard, the application of pressure by the left support assembly 30 and by the right side support assembly 40 is accomplished progressively to permit the chest or abdomen areas to be compressed until sufficient lateral support is provided, without over-compressing which would cause discomfort to the person, and to maintain the pressure so applied.

To enable the person to leave the bed 12, the assemblies 30 and 40 are adjusted to release the oppositely directed pressure, and are disengaged from the chest and abdomen areas.

Considering now the left side support assembly 30 and the right side support assembly 40, only the left side support assembly 30 will be considered hereinafter in greater detail as it is substantially similar to the right side support assembly 40. The left side support assembly 30 includes a plurality of laterally movable assemblies to engage different portions of the torso, including chest engaging assembly 31 which cooperates with the left vertical wall 22 to apply pressure to the left side of the chest area and abdomen engaging assembly 39 which similarly cooperates with the left vertical wall member 22 to apply pressure to the left side of the abdomen area. It will be understood by one skilled in the art that additional assemblies could be utilized to cooperate with the wall 22 to apply pressure to the left side of the torso for accommodating different sizes of persons, or to facilitate the application of varying amounts of pressure to additional locations on the left side of the torso.

In use, the chest support assembly 31 is adjusted to engage the left side of the chest area and apply pressure thereto. Similarly, the abdomen support assembly 39 is adjusted to engage the left side of the abdomen area and apply pressure thereto, wherein the adjustment of the chest support assembly 31 is accomplished independently from the adjustment of the abdomen support assembly 39. In this way, the amount of pressure applied to the chest by the chest support assembly 31 and the pressure applied to the abdomen by the abdomen support assembly 39 can be adjusted to be different from one another to accommodate different body shapes. Although in the preferred embodiment the application of pressure to the chest and abdomen areas is accomplished with the chest support assembly 31 and the abdomen support assembly 39, the chest support assembly 31 and the abdomen support assembly 39 could be combined into a unitary assembly for applying pressure to the left chest and abdomen area simultaneously.

Considering now the chest support assembly 31 and the abdomen support assembly 39, only the chest support assembly 31 will be considered hereinafter in greater detail as it is substantially similar to the abdomen support assembly 39. The chest support assembly 31 includes a substantially rigid block 32 having a sloped surface 33 for applying pressure to the left chest area. In this regard, the sloped surface 33 directs an angularly upwardly force onto the chest area to push up on the left side of the chest area. In order to enhance the comfort of the person, the corners of the block 32 nearest to the arm pit area may be rounded sufficiently to permit the person to bring the arms in closer to the torso without engaging sharp corners. A pillow or cushion 34 is disposed between the surface 33 and the chest to enhance the comfort of the person while the pressure is being applied thereto.

A threaded member 36 having a handle 38 at one end passes threadably through an opening 23 in the left vertical wall 22, and is connected rotatably at its other end to the block 32, wherein rotational movement of the threaded member 36 is translated into lateral movement of the block 32. A nut arrangement 35 located at the opening 23 enables the threaded member 36 to be secured releasably at any selected position.

Pressure is applied mechanically to the chest area by the block 32 through the cushion 34 by progressively rotating the threaded member 36 at the handle 38. After the threaded member 36 has been rotated to cause the block 32 to move laterally away from the left vertical wall 22, and to apply the desired amount of pressure which is sufficient to laterally support the chest, the nut assembly 35 is adjusted to secure and maintain the threaded member 36 in place and to prevent the threaded member from backing out of the opening 23 under the force exerted by the right side support assembly 40 on the right side of the torso. As a result, the chest area is restrained laterally and releasably between the cushion 34 and the right side support assembly 40.

When desired, the nut arrangement 35 is released and the threaded member 36 is rotated in the other direction to discontinue the application of pressure to the chest.

Figure 3:
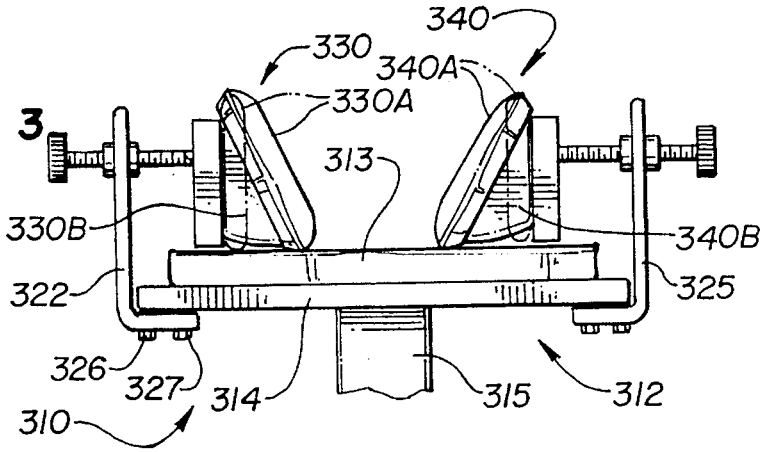
FIG. 3 is an elevational view of another chest and abdomen supporting apparatus, which is also used and constructed in accordance with the present invention.

Referring now to FIG. 3, there is shown a chest or abdomen support apparatus 310 for use with a hospital operating room table or slab 312 having a pedestal 315 to support a bottom member 314 and a mattress or pad 313.

The apparatus 310 is substantially similar to the apparatus 10, and similarly applies pressure to opposing sides of the chest or abdomen of a person laying in a supine position on the pad 313. However, the left side support assembly 330 and the right side support assembly 340 may be attached or removed from the bottom member 314 as required. In this regard, the left side support assembly 330 and the right side support assembly 340 cooperate with a removable left vertical member 322 and a removable right vertical member 325, respectively.

Considering now the vertical members 322 and 325, only the left vertical member 322 will be described hereinafter in greater detail as it is substantially similar to the right vertical member 325. Unlike the left vertical member 22 of FIG. 2, the left vertical member 322 can be removed from the bed 312 when there is no need for supporting the chest or abdomen areas, or when the members 322 and 325 would interfere with access to the person.

In order to removably secure the left vertical member 322 to the bed 312, the apparatus 310 further includes a pair of bolts 326 and 327 which cooperate with the member 314 to secure the vertical member 322 thereto. In this way, the left vertical member 322 can be secured removably to the table 312 for cooperating with the left side support assembly 330 to provide support, and can be removed from the table 312 for patients that do not require support. The use of other securing devices to attach removably the vertical member 322 to the member 314 are also contemplated.

Figure 4:
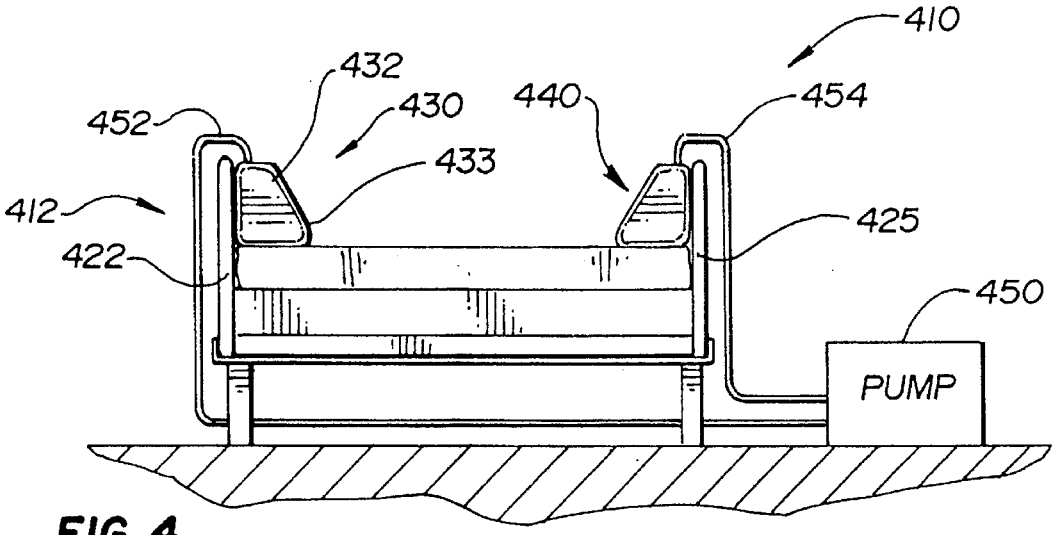
FIG. 4 is an elevational view of a further chest and abdomen supporting apparatus, which is also used and constructed in accordance with the present invention.

Referring now to FIG. 4, there is shown another chest or abdomen support apparatus 410 which is substantially similar to the apparatus 10 except that the application of pressure to opposing sides of the chest and abdomen is accomplished pneumatically rather than mechanically. In this regard, the apparatus 410 includes an inflatable left side support assembly 430 and an inflatable right side support assembly 440. The inflatable left side support assembly 430 and the inflatable right side support assembly 440 cooperate with vertical wall members 422 and 425, respectively, to apply opposing pressure to the chest and abdomen areas.

Considering now the inflatable left side support assembly 430 and the inflatable right side support assembly 440, only the inflatable left side support assembly 430 will be considered hereinafter in greater detail as it is substantially similar to the inflatable right side support assembly 440. The inflatable left side support assembly 430 includes a bladder 432 having a sloped surface 433 to apply a cushioned and angularly upwardly directed force to the chest and abdomen areas. A pump 450 is connected to the bladder 432 by a hose 452 to adjustably inflate the bladder for progressively applying pressure to the chest and abdomen areas, and to sustain the inflation of the bladder 432 for maintaining the application of the pressure to the chest and abdomen areas.

Figure 5:
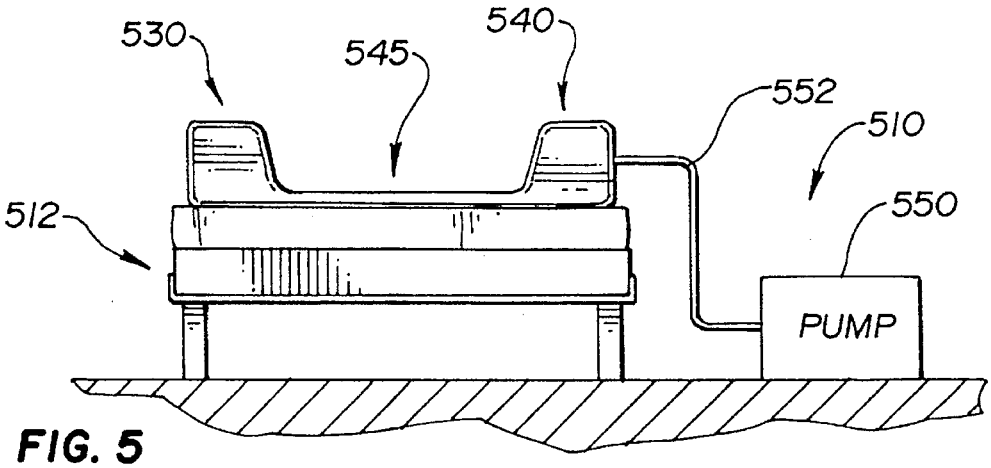
FIG. 5 is an elevational view of yet another chest and abdomen supporting apparatus, which is also used and constructed in accordance with the present invention.

Referring now to FIG. 5, there is shown another chest or abdomen support assembly apparatus 510 which is substantially similar to the apparatus 410, except that the left vertical wall member 422 and the right vertical wall member 425 are not required to exert opposing pressure on the chest or abdomen areas. In this regard, the apparatus 510 includes a left side support assembly 530 that is in fluid communication with a right side support assembly 540 via an intermediate bladder member 545. In this regard, the left side support assembly 530 and the right side support assembly 540 are inflated substantially simultaneously to apply opposing pressure to the chest and abdomen areas.

A pump 550 supplies the fluid via hose 552 to the right side support assembly 540 for inflation thereof. The intermediate bladder member 545 enables the fluid to be supplied substantially simultaneously to the left side support assembly 530, wherein the left side support assembly 530 and the right side support assembly 540 are inflated substantially simultaneously to apply a pressure to opposing sides of the chest and abdomen areas.

Figure 6:
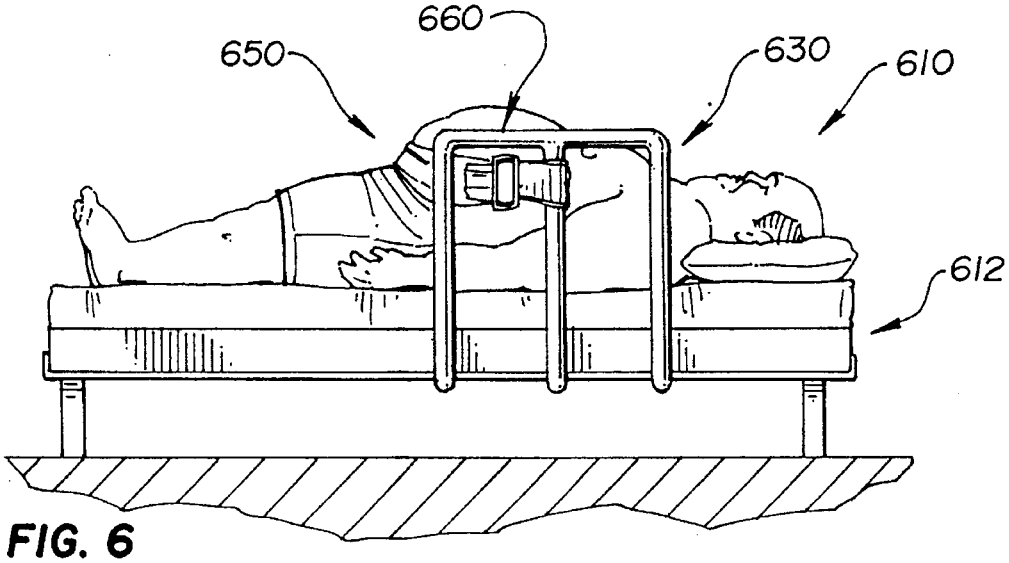
FIG. 6 is an elevational view of a further chest and abdomen supporting apparatus, which is also used and constructed in accordance with the present invention.

Referring now to FIG. 6, there is shown a lower abdomen support apparatus 610. The apparatus 610 is adapted for use with a bed 612 supported above the ground by a frame 615, and having a left upright rail assembly 630 and a right upright rail assembly (not shown).

A strap member 650 is attached at one end to the right upright rail assembly, and is secured releasably at its other end to the left upright rail assembly 630 by a buckle 660 wherein the strap member 650 is coupled between the right and left upright rail assemblies. The strap member 650 engages the lower abdomen of the person and operates to push up the lower abdomen as the strap length between the right upright rail assembly and the left upright rail assembly 630 is adjusted.

In use, the strap member 650 is brought across the lower abdomen from the right upright rail assembly, wrapped around the lower left upright rail assembly 630, and brought back on to itself and through the buckle 660. The strap member 650 is adjusted by passing the free end of the strap member 650 through the buckle 660, then pulling thereon to cause the length of the strap member 650 between the right upright rail assembly and the left upright rail assembly 630 to be reduced, thereby applying pressure to the lower abdomen. The application of the pressure to the lower abdomen by the strap member 650 enables the lower abdomen to be lifted and supported, thereby aiding in the comfort of the person. After reducing the length of the strap member 650 to the point where a sufficient amount of pressure is being applied to the lower abdomen, thereby preventing the abdomen from pressing down on internal cavities and organs therein, the strap member 650 is secured by the buckle 660 to maintain the application of the desired pressure to the lower abdomen.

While particular embodiments of the present invention have been disclosed, it is to be understood that various different modifications are possible and are contemplated within the true spirit and scope of the appended claims. For example, either the left side support assembly 30 or the right side support assembly 40 of FIGS. 1 and 2 could be fixed in position on the bed 12, while the other side support assembly would be moveable. In this situation, the person would be positioned to engage the fixed side support assembly with their abdomen or chest. The moveable side support assembly would then be moved into engagement with the other side of the abdomen or chest, thereby applying pressure to both sides of the abdomen or chest with both the fixed side support assembly and the moveable side support assembly. There is no intention, therefore, of limitations to the exact abstract or disclosure herein presented.

What is claimed is:

1. A method for supporting a chest or an abdomen of a person laying in a supine position on a stationary horizontal surface between a pair of spaced-apart oppositely disposed cushioned body engageable means, comprising:

positioning the person between the pair of cushioned body engaging means;

progressively applying pressure to one side of the abdomen or chest with a cushioned body engaging means relative to the other cushioned body engageable means to help facilitate the lateral support of the abdomen or chest;

extending a mechanical drive means on said one side above an arm of the user to help apply pressure progressively to said one side with said cushioned body engaging means;

engaging the other side of the abdomen or chest with the other cushioned body engaging means to progressively apply pressure to the other side in opposition to and concurrently with the pressure applied by said cushioned body engaging means to secure the person forcibly between the pair of cushioned body engageable means for causing pressure to be applied to both sides of the abdomen or chest;

extending another mechanical drive means on said other side above another arm of the user to help apply pressure progressively to said other side with said other cushioned body engaging means; and maintaining the application of the pressure on both of said sides of the abdomen or chest with pressure maintaining means coupled to said pair of cushioned body engaging means to restrain laterally releasably the abdomen or chest between said pair of cushioned body engaging means.

2. A method for supporting a chest or an abdomen of a person laying in a supine position on a horizontal surface between a pair of spaced-apart oppositely disposed cushioned body engageable means, comprising:

positioning the person between the pair of cushioned body engaging means;

progressively applying pressure to one side of the abdomen or chest with a cushioned body engaging means relative to the other cushioned body engageable means to help facilitate the lateral support of the abdomen or chest;

engaging the other side of the abdomen or chest with the other cushioned body engaging means to secure the person forcibly between the pair of cushioned body engageable means for causing pressure to be applied to both sides of the abdomen or chest;

maintaining the application of the pressure on both of said sides of the abdomen or chest with pressure maintaining means coupled to said pair of cushioned body engaging means to restrain laterally releasably the abdomen or chest between said pair of cushioned body engaging means;

directing an angularly upwardly force on said one side of the abdomen or chest with a sloped surface on one of said cushioned body engaging means; and directing another angularly upwardly force on said other side of the abdomen or chest with another sloped surface on said other cushioned body engaging means to push the abdomen or chest upwardly.

3. A method according to claim 2, further including mechanically controlling the progressive application of said pressure by said cushioned body engaging means to said one side of the abdomen or chest with a mechanical means.

4. A method according to claim 2, further including pneumatically controlling the progressive application of said pressure by said cushioned body engaging means to said one side of the abdomen or chest with a pneumatic means.

5. A method according to claim 2, wherein said progressively applying pressure to said one side of the abdomen or chest includes applying pressure to the abdomen with an abdomen engaging means independently of applying pressure to the chest with a chest engaging means.

6. A method according to claim 5, wherein said engaging the other side of the abdomen or chest includes engaging the abdomen with another abdomen engaging means independently of engaging the chest with another chest engaging means.

7. A method according to claim 2, further including attaching removably brace members to opposite sides of the horizontal surface for cooperating with said pressure maintaining means to facilitate the maintaining of the application of said pressure.

8. An apparatus for supporting a chest or an abdomen of a person laying in a supine position on a stationary horizontal surface, comprising:

cushioned body engaging means for progressively applying pressure to one side of the abdomen or chest to help facilitate the lateral support thereof;

a mechanical drive means extending from said one side above an arm of the user to help apply pressure progressively with said cushioned body engaging means;

another cushioned body engaging means for progressively applying pressure to another side of the abdomen or chest to provide sufficient pressure in opposition to the concurrent application of pressure to said one side by said cushioned body engaging means for providing sufficient lateral support for the abdomen or chest to help prevent it from pressing downwardly on the internal cavities or organs of the body;

another mechanical drive means extending from said other side above another arm of the user to help apply pressure progressively with said other cushioned body engaging means; and pressure maintaining means coupled to said cushioned body engaging means and said another cushioned body engaging means for maintaining the application of the pressure on both sides of the abdomen or chest to restrain laterally releasably the abdomen or chest between said cushioned body engaging means and said another cushioned body engaging means.

9. An apparatus for supporting a chest or an abdomen of a person laying in a supine position on a horizontal surface, comprising:

cushioned body engaging means for progressively applying pressure to one side of the abdomen or chest to help facilitate the lateral support thereof;

another cushioned body engaging means for progressively applying pressure to another side of the abdomen or chest to provide sufficient pressure in opposition to the pressure applied to said one side for providing sufficient lateral support for the abdomen or chest to help prevent it from pressing downwardly on the internal cavities or organs of the body;

pressure maintaining means coupled to said cushioned body engaging means and said another cushioned body engaging means for maintaining the application of the pressure on both sides of the abdomen or chest to restrain laterally releasably the abdomen or chest between said cushioned body engaging means and said another cushioned body engaging means;

wherein said cushioned body engaging means includes a sloped surface to direct an angularly upwardly force to said one side of the abdomen or chest; and said another cushioned body engaging means includes another sloped surface to direct another angularly upwardly force to said another side of the abdomen or chest for pushing upwardly the abdomen and chest.

10. An apparatus according to claim 9, wherein said pressure maintaining means includes a mechanical means for controlling the application of said pressure by said cushioned body engaging means and by said another cushioned body engaging means.

11. An apparatus according to claim 9, wherein said pressure maintaining means includes a pneumatic means for controlling the application of said pressure by said cushioned body engaging means and by said another cushioned body engaging means.

12. An apparatus according to claim 9, wherein said cushioned body engaging means includes an abdomen engaging means for progressively applying pressure to the abdomen and a chest engaging means for progressively applying pressure to the chest, wherein said abdomen engaging means and said chest engaging means apply pressure to the abdomen and chest independently from one another.

13. An apparatus according to claim 12, wherein said another cushioned body engaging means includes another abdomen engaging means for progressively applying pressure to the abdomen and another chest engaging means for applying pressure to the chest, wherein said another abdomen engaging means and said another chest engaging means apply pressure to the abdomen and chest independently from one another.

14. An apparatus according to claim 9, further including brace members attached removably to opposite sides of the horizontal surface for cooperating with said pressure maintaining means to facilitate the maintaining of the application of said pressure to both sides.

15. A method for supporting the abdomen of a person laying in a supine position on a horizontal surface having a pair of oppositely disposed upright members secured thereto, comprising:

engaging the lower abdomen with an adjustable strap means coupled between the upright members;

adjusting said strap means to apply pressure for providing sufficient support to the lower abdomen to help prevent it from pressing downwardly on the internal cavities and organs of the abdomen area; and maintaining the application of said pressure to the lower abdomen with buckle means coupled to said strap means to sustain the support of the abdomen area.

* * * * *